US011286585B2

(12) United States Patent
Küsters et al.

(10) Patent No.: US 11,286,585 B2
(45) Date of Patent: Mar. 29, 2022

(54) METHOD AND APPARATUS FOR PROCESSING FIBERS

(71) Applicant: Truetzschler GmbH & Co. KG., Moenchengladbach (DE)

(72) Inventors: Dominik Küsters, Moenchengladbach (DE); Pedro Corrales-Arregui, Moenchengladbach (DE); Christoph Färber, Korschenbroich (DE)

(73) Assignee: Trützschler Group SE, Moenchengladbach (DE)

( * ) Notice: Subject to any disclaimer, the term of this patent is extended or adjusted under 35 U.S.C. 154(b) by 176 days.

(21) Appl. No.: 16/483,377

(22) PCT Filed: Dec. 1, 2017

(86) PCT No.: PCT/EP2017/081189
§ 371 (c)(1),
(2) Date: Aug. 2, 2019

(87) PCT Pub. No.: WO2018/145792
PCT Pub. Date: Aug. 16, 2018

(65) Prior Publication Data

US 2020/0032426 A1 Jan. 30, 2020

(30) Foreign Application Priority Data

Feb. 9, 2017 (DE) ..... 102017102623.1

(51) Int. Cl.
*D01H 5/00* (2006.01)
*D01G 15/10* (2006.01)
(Continued)

(52) U.S. Cl.
CPC ..... *D01H 5/005* (2013.01); *D01G 15/10* (2013.01); *D01G 21/00* (2013.01); *D01H 4/02* (2013.01); *D10B 2201/24* (2013.01)

(58) Field of Classification Search
CPC ..... D01H 4/02; D01H 5/005; D01G 15/10; D01G 21/00
See application file for complete search history.

(56) References Cited

U.S. PATENT DOCUMENTS 1,583,425 A 5/1926 Sheldon
2,950,591 A * 8/1960 Mandukich ..... D02G 3/025 57/315
(Continued)

FOREIGN PATENT DOCUMENTS

CN 1707001 A 12/2005
CN 102493024 A 6/2012
(Continued)

OTHER PUBLICATIONS

International Search Report in PCT/EP2017/081189 dated Mar. 23, 2018.
(Continued)

*Primary Examiner* — Shaun R Hurley
(74) *Attorney, Agent, or Firm* — FisherBroyles, LLP; Robert Kinberg

(57) ABSTRACT

A process and an installation for producing a yarn in accordance with an airjet-spinning method. A carded fibre sliver is subjected to more than three-fold drawing without levelling at a carding machine and deposited in a can (C). At least nine fibre slivers are fed draftfree from cans (C) to a draw frame and subjected to at least 8.5-fold drawing to form a fibre sliver and deposited in a can (C1). The fibre sliver in the cans (C1) is then fed to a spinning station of an airjet-spinning machine.

16 Claims, 5 Drawing Sheets

(51) Int. Cl.
*D01G 21/00* (2006.01)
*D01H 4/02* (2006.01)

(56) References Cited

U.S. PATENT DOCUMENTS 3,128,506 A * 4/1964 Brandt ..... D01G 21/00 19/115 R
3,447,206 A * 6/1969 Klein ..... D01H 5/72 19/243
3,562,867 A * 2/1971 Kaiser ..... D01H 5/005 19/243
3,922,642 A * 11/1975 Tooka ..... D01H 13/32 700/139
4,127,920 A * 12/1978 Gasser ..... D01H 5/005 19/157
4,266,324 A 5/1981 Hasegawa et al.
5,323,598 A * 6/1994 Stahlecker ..... D01H 5/005 57/315
5,343,598 A * 9/1994 Hauner ..... D01G 15/46 19/150
5,535,488 A * 7/1996 Yao ..... D01G 15/10 19/239
5,701,729 A * 12/1997 Rees ..... D02G 3/324 57/12
6,058,570 A * 5/2000 Baechler ..... D01H 1/22 19/157
6,286,188 B1 * 9/2001 Muller ..... D01G 15/64 19/236
6,393,667 B1 * 5/2002 Slavik ..... B65H 54/80 19/236
6,581,248 B1 * 6/2003 Muller ..... D01G 15/64 19/239
8,720,174 B2 5/2014 Kochmann
2006/0260100 A1 * 11/2006 Duda ..... D01G 23/06 19/236
2007/0028422 A1 * 2/2007 Minter ..... D01G 31/006 19/239
2008/0301911 A1 * 12/2008 Breuer ..... D01G 31/00 19/0.21

FOREIGN PATENT DOCUMENTS

CN 202576689 U 12/2012
JP 2006233414 A 9/2006
JP 2008531862 A 8/2008
JP 2009263858 A 11/2009
JP 2011089246 A 5/2011

OTHER PUBLICATIONS

Written Opinion for PCT/EP2017/081189 dated Mar. 23, 2018.
Weide, Thomas, "Chapter 5: Processing of man-made staple fibres in spinning mill", Rieter Machine Works Ltd., The Rieter Manual of Spinning, vol. 7—Processing of Man-Made Fibres, Jan. 2014, pp. 31-71 (Full Document—pp. 1-78).
Anonymous, "Karden—Getting fibers into shape", Trützschler GmbH & Co. KG Textilmaschinenfabrik, Apr. 2016, pp. 1-68, https://www.truetzschler-spinning.de/fileadmin/user_upload/truetzschler_spinning/downloads/broschuere/Karde/Karde_DE.pdf.
Anonymous, "Strecken—Getting fibers into shape", Trützschler GmbH & Co. KG Textilmaschinenfabrik, Mar. 2016, pp. 1-60, https://www.truetzschler-spinning.de/fileadmin/user_upload/truetzschler_spinning/downloads/broschuere/Strecke/Strecke_DE.pdf.
Anonymous, "C 70—High-Performance Card C70", Rieter Machine Works Ltd, Nov. 2016, p. 1-32.
Carter, Short Staple Pre-Spinning Machinery at ITMA '03, vol. 3, Issue 3, Fall 2003, NC State University, Journal of Textile and Apparel, Technology and Management, pp. 1-9.
Rieter, C 70 High-Performance Card, Fiber Preparation, www.reiter.com, webpage, pp. 1-24, date unknown.
Anonymous, Texdata International, Magazine, Issue No. 5, Sep./Oct. 2012, 73 pages.
Angelova, Air-Jet Spinning, Advances in Yam Spinning Technology, 2010, 1 page.
Before the Controller of Patents Chennai, Opposition under Section 25(1) of The Patents Act, 1970 to Patents Application No. 201947035566 dated Jan. 12, 2017 (Nationalization date: Apr. 9, 2019) entitled "method and apparatus for processing fibers"made by Trützschler Gmbh & Co. KG.
Japanese Decision to Grant a Patent in corresponding JP Patent Application No. 2019-543069, accessed through Global Dossier, date of drafting May 13, 2021, 2 pages.
CN First Search Report in corresponding Chinese Patent Application No. 2017800857990, dated Apr. 27, 2021, accessed through Global Dossier, 2 pages.

* cited by examiner

METHOD AND APPARATUS FOR PROCESSING FIBERS

CROSS-REFERENCE TO RELATED APPLICATIONS

This application is a U.S. National Stage Application of International Patent Application No. PCT/EP2017/081189, filed Dec. 1, 2017, which claims benefit of German Patent Application No. 10 2017 102 623.1, filed Feb. 9, 2017.

BACKGROUND OF THE INVENTION

The present invention relates to a process and an installation for processing fibres and especially a process for producing a yarn in accordance with the airjet-spinning method.

In airjet-spinning, the fibres of a fibre sliver are caused to swirl helically by means of compressed air in a nozzle and processed to form a yarn. Usually a fibre length of at least 30 mm is necessary for that purpose in order to achieve a sufficient yarn strength. The fibres processed are predominantly synthetic fibres, such as viscose or polyester, or yarn blends of cotton with viscose or polyester. For that purpose, according to the prior art the fibres are carded and are doubled and drawn in three subsequent drawing units, in each case fed by from six to eight cans. The preparation of the fibre sliver to be processed is a very expensive procedure because a very large amount of space is required for the carding machine and the subsequent three drawing units. Furthermore, the work involved in transporting the cans, each with a different fibre quality, is very substantial and personnel-intensive.

SUMMARY OF THE INVENTION

The object of the invention is to provide a simplified process and the associated installation for processing fibres.

That object is achieved by a process for processing fibres, which in one embodiment comprises steps of: producing on a carding machine a carded fibre sliver; subjecting the carded fibre sliver to preliminary drawing to produce a pre-drawn fibre sliver; depositing the pre-drawn fibre sliver in one of a plurality of first cans; feeding draftfree at least 9 to 12 of the pre-drawn fibre slivers from a corresponding number of first cans of the plurality of first cans to a draw frame and drawing the at least 9 to 12 pre-drawn fibre slivers on the draw frame to form a drawn fibre sliver; depositing the drawn fibre sliver in one of a plurality of second cans; and feeding the drawn fibre sliver in the one second can to a spinning station of an airjet-spinning machine.

The object is further achieved by an installation for producing a yarn in accordance with an airjet-spinning method, comprising: a carding machine; an integrated draw frame and a can changer arranged at the carding machine; a single drawing unit in a form of an autoleveller drawing unit; and a driven creel and an airjet spinning machine arranged downstream of the single drawing unit.

In the process according to the invention for processing fibres, a carded fibre sliver formed on a carding machine is preferably subjected to more than three-fold preliminary drawing on that carding machine and deposited in a first can. At least nine of the pre-drawn fibre slivers so produced are fed draftfree from a plurality of first cans, the number of which corresponds to the number of pre-drawn fibre slivers being fed, to a draw frame where they are preferably subjected to at least 8.5-fold drawing to form a drawn fibre sliver and deposited in one of second cans. The drawn fibre sliver so produced in a respective one of the second cans is fed to a spinning station of an airjet-spinning machine where the fed, drawn fibre sliver is accordingly spun. Alternatively or in addition thereto, the drawn fibre sliver fed to the airjet-spinning machine has preferably been subjected to at least 20-fold drawing with respect to the carded fibre sliver.

The core concept of the invention is to effect drawing of a preferably heavy, carded fibre sliver in only two steps. At the carding machine, in a first step, the carded fibre sliver is subjected to preliminary drawing in an integrated draw frame and deposited in one of first cans. In so doing, in accordance with the well-known hook theory, the hooks located at the rear ends of the fibres in the transport direction are virtually eliminated. In the context of the invention the term "first can" means: provided for receiving the pre-drawn fibre sliver produced on the carding machine. Accordingly, the term "second can" means: provided for receiving the drawn fibre sliver produced on the draw frame which is then fed to the airjet-spinning machine. The first and second cans can accordingly be of entirely identical construction and in the context of the process differ from one another only in respect of the nature of the fibre sliver received. In a second step, at least nine of those pre-drawn fibre slivers are fed to a draw frame. Because more fibre slivers are fed to the draw frame than in accordance with the prior art, and those fibre slivers are subject to greater friction on account of the longer feed path into the drawing unit, a driven creel is advantageously used in order that the fibre slivers are able to run draftfree into the draw frame. A further aspect is that the second drawing of the fibre sliver allows removal again of the hooks located at the rear ends of the fibres in the transport direction. As a result of the prior deposition of the pre-drawn fibre sliver in a first can, the fibres are removed from the respective first can in the reverse direction relative to the carding machine, so that the direction of movement of the fibres in the draw frame is reversed. As a result of the drawing being carried out twice, this makes it possible largely to eliminate the hooks at both ends of the fibres.

Because a relatively heavy sliver is preferably subjected to at least 8-fold, 8.5-fold or even 9-fold drafting or drawing in the draw frame (30), it is possible to dispense with two separate drawing units.

Advantageously, the carded fibre sliver has at least 2.7 ktex. By virtue of the high sliver weight it is possible to operate with relatively high drafts.

Advantageously, the carded fibre sliver is subjected to at least 2.5-fold, 3-fold or even at least 3.5-fold drawing at the carding machine. This results in the best yarn values at the airjet-spinning machine for the process as a whole.

Drawing the fibre sliver preferably without levelling at the carding machine results in a very space-saving arrangement of an integrated draw frame, which can be positioned in vertical alignment above the coiler head of a can coiler.

In a preferred embodiment the carding machine produces at least 80 kg/h of fibre sliver. This results in an optimum machine configuration for supplying the spinning stations of the airjet-spinning machine using a minimum of carding machines and draw frames.

Advantageously, the carded fibre sliver has at least 2.9 ktex, preferably at least 3.5 ktex. As a result of the increasing sliver weight it is possible to operate with relatively high drafts, which in turn has a positive effect on yarn quality.

In a preferred embodiment, during a can change the fibre sliver can be buffered prior to the preliminary drawing at the carding machine. The carding machine does not need to be stopped during can changing, but can continue to operate with lower productivity, the productivity of the carding machine being reduced to an extent such that there are no losses of quality in the carded fibre sliver produced.

Surprisingly it has been found that in the event of a reduction in productivity below a production speed of 100 m/min, the quality of the card sliver or carded fibre sliver is limited. Therefore in buffering mode (that is to say during the can change) the carding machine is operated at a speed of at least 100 m/min.

If the pre-drawn fibre sliver is subjected to at least 9-fold drawing, a drawn fibre sliver having sufficient quality to be fed to an airjet-spinning machine is produced using a single autoleveller draw frame.

In a preferred embodiment, at least 12 fibre slivers are fed draftfree into the draw frame. By means of the driven creel it is possible to avoid or compensate for the friction that arises on account of the longer transport path of the fibre slivers and the tension draft can be sensitively regulated.

An installation according to the invention for producing a yarn in accordance with the airjet-spinning method comprises a carding machine having an integrated draw frame and a can changer, a single drawing unit which is in the form of an autoleveller drawing unit and downstream of which there is arranged a driven creel, and an airjet-spinning machine.

The installation can be operated with a relatively large variation in sliver numbers and relatively high drafts, so that two drawing units can be dispensed with. As a result, the installation becomes more compact and can changing can be reduced to a minimum.

As a result of the heavy slivers produced in the carding machine, the carding machine advantageously has a transverse sliver take-off with which the carded web is delivered in the form of a card sliver or fibre sliver.

Advantageously, between the carding machine and the integrated draw frame there is arranged a sliver loop buffer with which continuous operation of the installation is achieved. Due to the fact that the carding machine does not need to be stopped for can changing, it is possible to achieve higher productivity together with a constant quality.

In a preferred embodiment, the driven creel has a drive which is operable and controllable independently of a drive of the drawing unit. Accordingly, the tension draft on the fibre slivers on being fed into the drawing unit can be regulated very precisely.

In a further preferred embodiment, the drawing unit has a draw frame autoleveller which adapts the main draft of the draw frame to possible mass fluctuations of the incoming fibre slivers. In the case of the very high doubling of at least nine fibre slivers, preferably 12 fibre slivers, and the high draft in the draw frame there is obtained a high-quality fibre sliver which can be fed to a spinning station on an airjet-spinning machine without further processing.

Preferably, upstream of the draw frame autoleveller there is arranged a funnel which has an opening angle that decreases in the sliver running direction. A first condensing or compacting of the at least nine fibre slivers therefore takes place in the funnel, the decreasing opening angle ensuring continuous condensing.

The opening angle can decrease stepwise or continuously. The step-like arrangement of the opening angles can be implemented very economically from the production standpoint. The continuous decrease in the opening angle is more advantageous for the first condensing of the fibre slivers.

Each of the afore-mentioned installations is preferably adapted to be operated in accordance with one of the afore-mentioned processes. That is to say, an installation that has a relatively simple structure per se is capable of achieving the advantages defined in the afore-mentioned processes.

BRIEF DESCRIPTION OF THE DRAWINGS

Further measures enhancing the invention are described in detail below together with the description of a preferred exemplary embodiment of the invention with reference to the Figures, wherein.

DETAILED DESCRIPTION OF THE INVENTION

Figures 1, 2A:
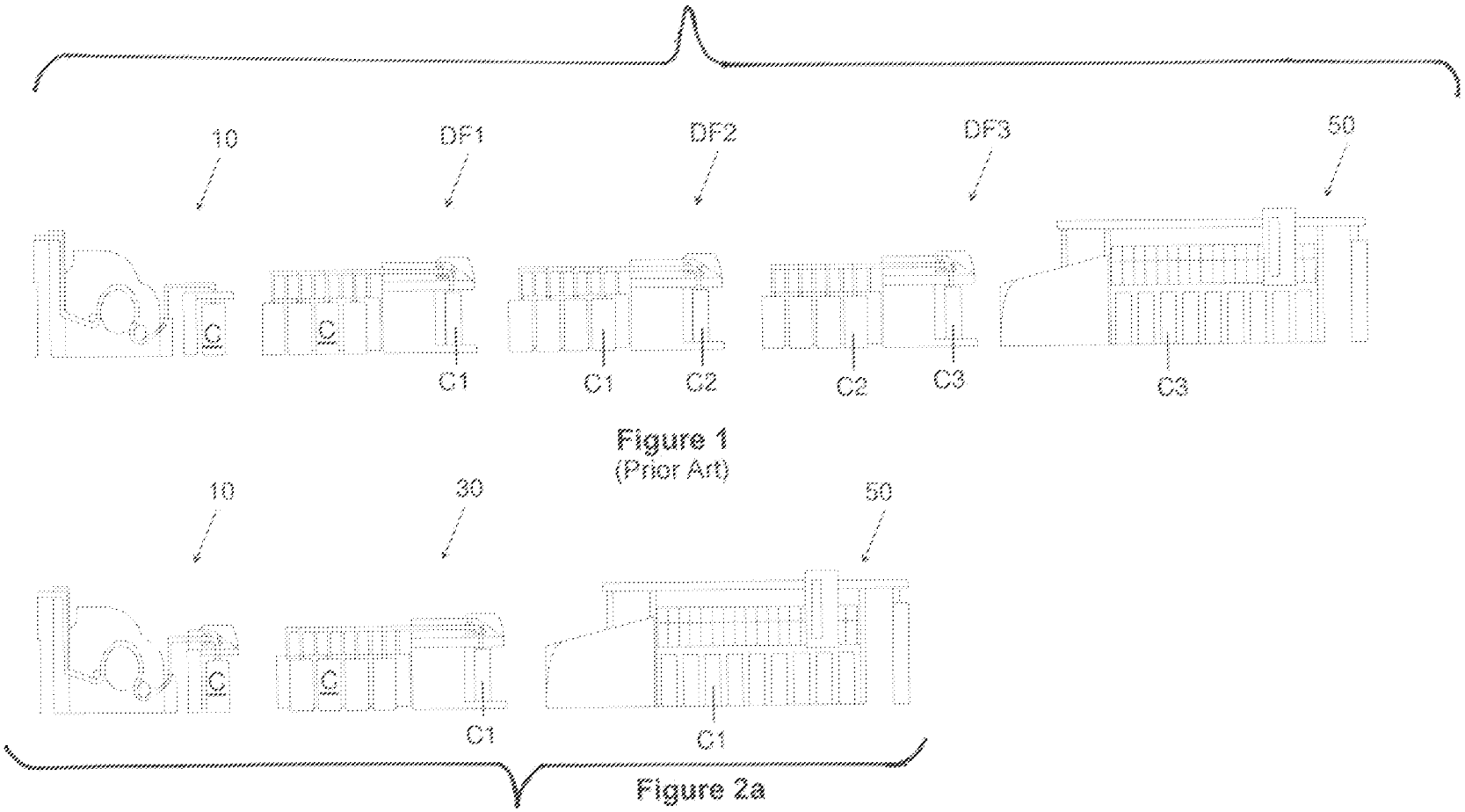
Figure 1 (Prior Art)
FIG. 1 shows the layout of an installation according to the prior art.

According to the prior art (FIG. 1), fibres are aligned in a carding machine 10 and deposited in the form of a carded fibre sliver in a can C. A total of from six to eight of these cans C are used to feed a first draw frame DF1 and doubled and drawn. The fibre sliver generated in the first draw frame DF1 is again deposited in a can C1 and doubled and drawn with a further five to seven fibre slivers in a second draw frame DF2. The then drawn fibre sliver is deposited in a can C2 and drawn with a total of from six to eight fibre slivers in the draw frame DF3. The fibre sliver that has been drawn in the third draw frame DF3 is again deposited in cans C3 and fed to the airjet-spinning machine 50. Usually the third draw frame DF3 is in the form of an autoleveller draw frame. According to the prior art, the fibre sliver in each draw frame DF1, DF2, DF3 is subjected to from six-fold to eight-fold drafting, so that in total a maximum of up to 512-fold drawing takes place. The main disadvantages of this process are the large amount of space required for a total of five machines with the associated cans and the laborious and personnel-intensive handling of the cans with which the fibre sliver is transported to the respective next machine.

The process of the invention in accordance with FIGS. 2 to 5 provides drawing of the fibre sliver carded by the carding machine 10 in only two steps. The first (preliminary) drawing operation is effected at the carding machine 10 before the fibre sliver is deposited in the can C. Here, in front of or above the can coiler 22, there is arranged an integrated draw frame 20 having a drafting zone without levelling, which draws the card sliver or fibre sliver by a factor >2.5, preferably 3.0 and more preferably ≥3.5. The pre-drawn fibre sliver then deposited in the can C is transported to a draw frame 30 where it is drawn by the factor ≥8.5, preferably by the factor ≥9, deposited in a can C1 and processed to form a yarn in the airjet-spinning machine 50. The invention has the advantage that it is possible to dispense with two entire drawing units, for example DF1 and DF2, and accordingly only two, instead of four, can transports are necessary for the fibre sliver. According to the invention the fibre sliver is drawn only twice, a draw frame 20 being integrated at or in the can coiler of the carding machine 10.

FIG. 2*a* shows an installation suitable for that purpose. In addition to the afore-mentioned advantages, the entire arrangement has a substantially smaller space requirement in comparison with the prior art, because in comparison with the carding machine 10 with the can coiler, the draw frame 20, which is functionally integrated into the carding machine 10, has a substantially smaller additional space requirement than two complete draw frames DF2, DF3 with the respective creels and can coilers.

Figure 2B:
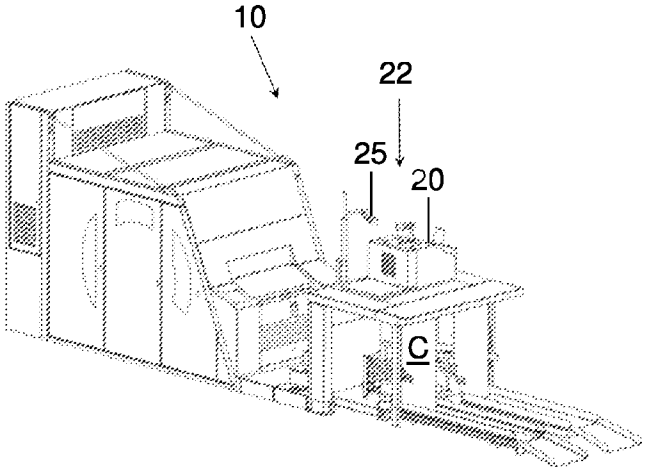
FIG. 2 shows the layout of an installation according to the invention.

FIG. 2*b* shows the carding machine 10 with the integrated draw frame 20 in greater detail and serves to clarify the proportions of that part of the installation. It can especially be seen that the integrated draw frame 20 has dimensions which in an extreme case do not require any increase in the length and width of the can coiler, so that the space requirement of the carding machine 10 and can coiler 22 does not change whatsoever and so partial or full integration, for example as replacement, into existing installation is possible.

Figure 2D:
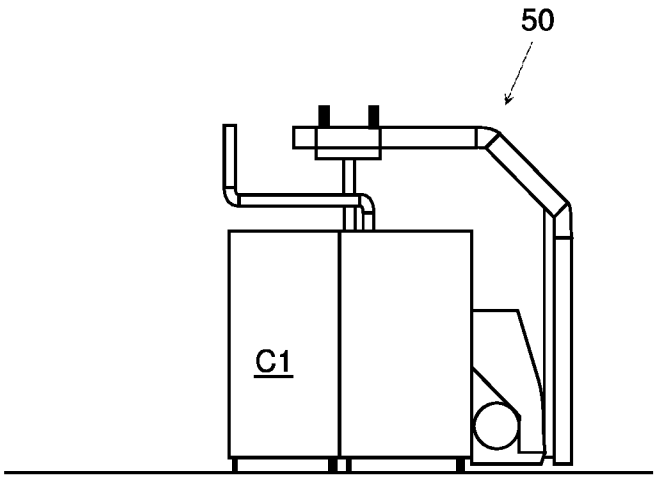
Figure 2C:
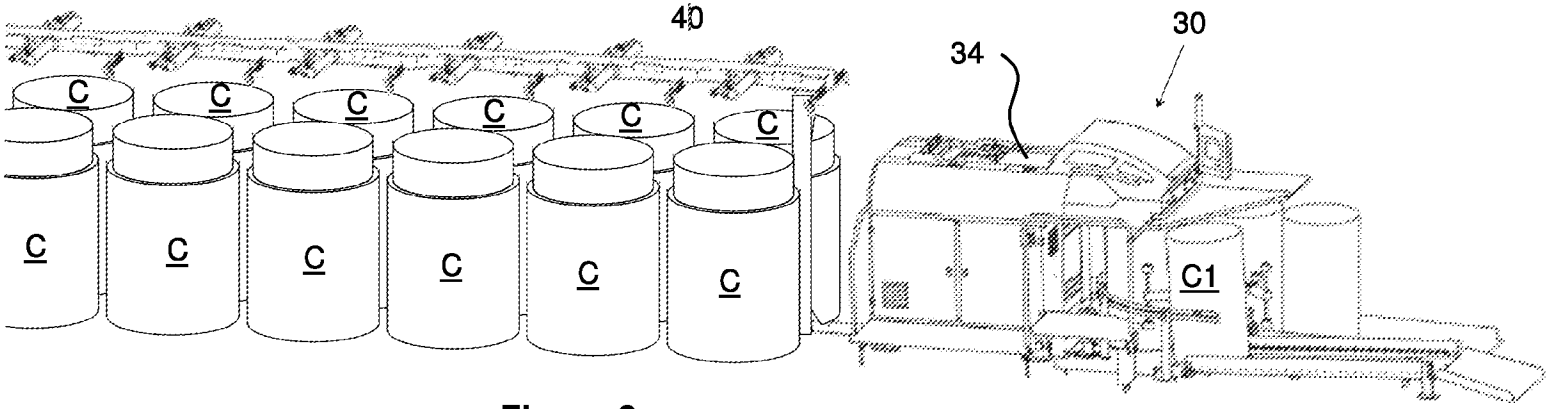
Figure 3:
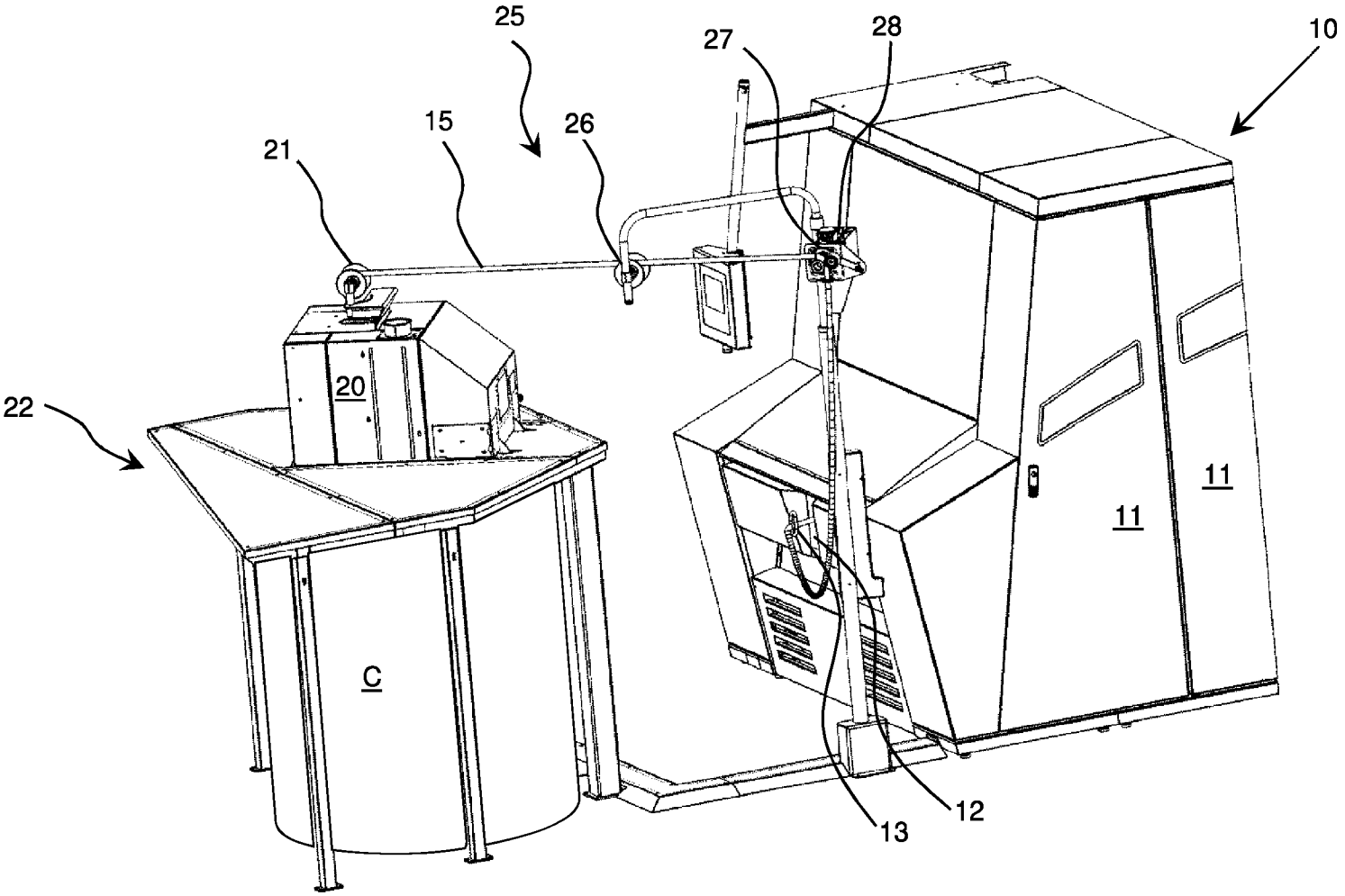
FIG. 3 shows the loop buffer at the carding machine.

FIG. 2*c* shows a draw frame 30 with by way of example twelve cans C arranged at a creel, which cans contain pre-drawn fibre slivers which are fed into the draw frame 30.

FIG. 2*d* shows the airjet-spinning machine 50 from the direction of one end face, that is to say in the direction of its longitudinal extent.

The technological difference with respect to the prior art lies in the fact that according to the invention a much heavier and thicker sliver is processed over the entire process, which sliver is subjected to a much greater degree of drawing in the single draw frame 30. The fibre sliver produced in the carding machine 10 has a quality of advantageously at least 2.7 ktex, preferably at least 2.9 ktex. Especially good results can be achieved with a carded fibre sliver of at least 3.5 ktex. For that purpose it is necessary, on account of the sliver weight, for the carding machine 10 to have a transverse sliver take-off with which the carded web can be delivered to form a carded or card sliver. For the continuous process, the production rate of the carding machine 10 is at least 80 kg/h. For the continuous process it can likewise be expedient to use a sliver loop buffer 25 which will be explained in detail in FIG. 3. The draw frame 20 integrated into the sliver coiler 22 has also been modified for heavy and thick fibre slivers by the use of only one drafting zone, without levelling, in which the incoming fibre slivers are drawn by the factor >3.0, preferably ≥3.5.

The buffer arranged between the carding machine 10 and the integrated draw frame 20 is preferably in the form of a sliver loop buffer 25, the object of which is to ensure the continuous process of fibre sliver production. Without the sliver loop buffer 25 the production rate of the carding machine 10 would have to be reduced to a much greater extent during can changing, which means losses of quality in the uniformity of the fibre sliver 15 and is reflected in an increase in thin places in the yarn produced. In the subsequent very intense two-step drawing on the draw frame 30, or in its drawing unit, the mass fluctuations in the fibre sliver 15 generated by varying production rates have an extremely adverse effect on the yarn produced in the airjet-spinning machine, which becomes non-uniform as a result. According to the prior art, a non-uniformly produced card sliver can be improved in quality by the multi-step drawing, so that the sliver loop buffer 25 is not required in the case of such use.

In normal operation, the carded fibre sliver 15, which is formed from a web by the transverse sliver take-off inside the housing 11, is withdrawn from the carding machine 10 through an opening 12 and guided through a ring 13. The fibre sliver 15 is then guided via a drive roller 27 and further via a roller 26 to a roller 21 which then conducts the fibre sliver 15 into the integrated draw frame 20. The rollers 21, 26 and 27 are arranged at a height above the integrated draw frame 20 that can be about from 1.8 m to 2.5 m. In particular, the rollers 26 and 27 can be arranged on a separate framework which is attached to the floor or the ceiling of the spinning room. During such normal operation the drive roller 27 can be driven, operated in idle mode or arranged to be fixed, so that the fibre sliver 15 is pulled by the integrated draw frame 20 or the coiler head and slides over it. Alternatively, the drive roller 27 can be operated at a speed corresponding to a feed speed of the can changer 22 or the draw frame 20 with which the fibre sliver 15 is drawn into the can changer 22. This avoids the risk of the fibre sliver tearing as a result of the change in direction of the fibre sliver. The delivery speed of the fibre sliver 15 from the carding machine 10 can be between 140 and 250 m/min, preferably 200 m/min. In the integrated drawing unit 20, the carded fibre sliver 15 can be accelerated to a speed of about 700 m/min before being deposited in the can C.

Once the can C is full, the fibre sliver 15 must be significantly reduced in speed or stopped until the full can C has been replaced by a fresh, empty can C. This operation requires a certain amount of time, during which the carding machine 10 should not actually deliver any further fibre sliver 15. However this results in very discontinuous operation of the carding machine 10, especially as a result of the frequent braking to a standstill and re-acceleration of the relatively large carding cylinder. In order to avoid this, intermediate buffering of the fibre sliver 15 between the rollers 26 and 27 and between the roller 27 and the ring 13 is provided. For that purpose, the drive roller 27 is driven and at the same time the fibre sliver is clamped between the drive roller 27 and a presser element 28 (presser roller or spring). The fibre sliver 15 is thus transported further by the drive roller 27 independently of the speed of the carding machine 10 and the integrated drawing unit 20, the carding machine 10 being braked to a speed which results in a minimum of mass fluctuations in the fibre sliver 15 produced. The delivery speed of the carding machine 10 is preferably at least 100 m/min.

In order that the fibre sliver 15 thereby produced is not allowed to run all over the place in an uncontrolled way, the drive roller 27 is driven at a speed that is equal to or lower than the output speed of the carding machine 10 at the ring 13. Accordingly, a loop is formed in the fibre sliver 15 between the ring 13 and the drive roller 27, which loop can reach as far as the floor.

Since, as a result of the can change, the fibre sliver 15 is also not being transported further at the drawing unit of the integrated draw frame 20, a second loop is formed between the rollers 26 and 27. Such loop formation, which results from the difference in transport speed between the drive roller 27 and the carding machine 10, is sufficient to provide an intermediate buffer for the duration of a can change, during which the production speed of the carding machine 10 is reduced.

The draw frame 30 differs from the prior art by processing at least 9 pre-drawn fibre slivers (see FIG. 2*a*), preferably 12 pre-drawn fibre slivers (see FIG. 2*c*), which are drawn by the factor ≥8.5, preferably by the factor ≥9, and deposited in the cans C1 as a drawn fibre sliver. Depending upon the fibre quality, a draft of up to the factor 12 can be expedient. Since the feed into the draw frame 30 provides a much longer creel 40, via which 9, 10, 12 or more fibre slivers are fed into the head of the drawing unit, the use of a driven creel 40 makes it possible to compensate for the friction that arises as a result of the longer transport path and to regulate the tension draft.

Figure 4:
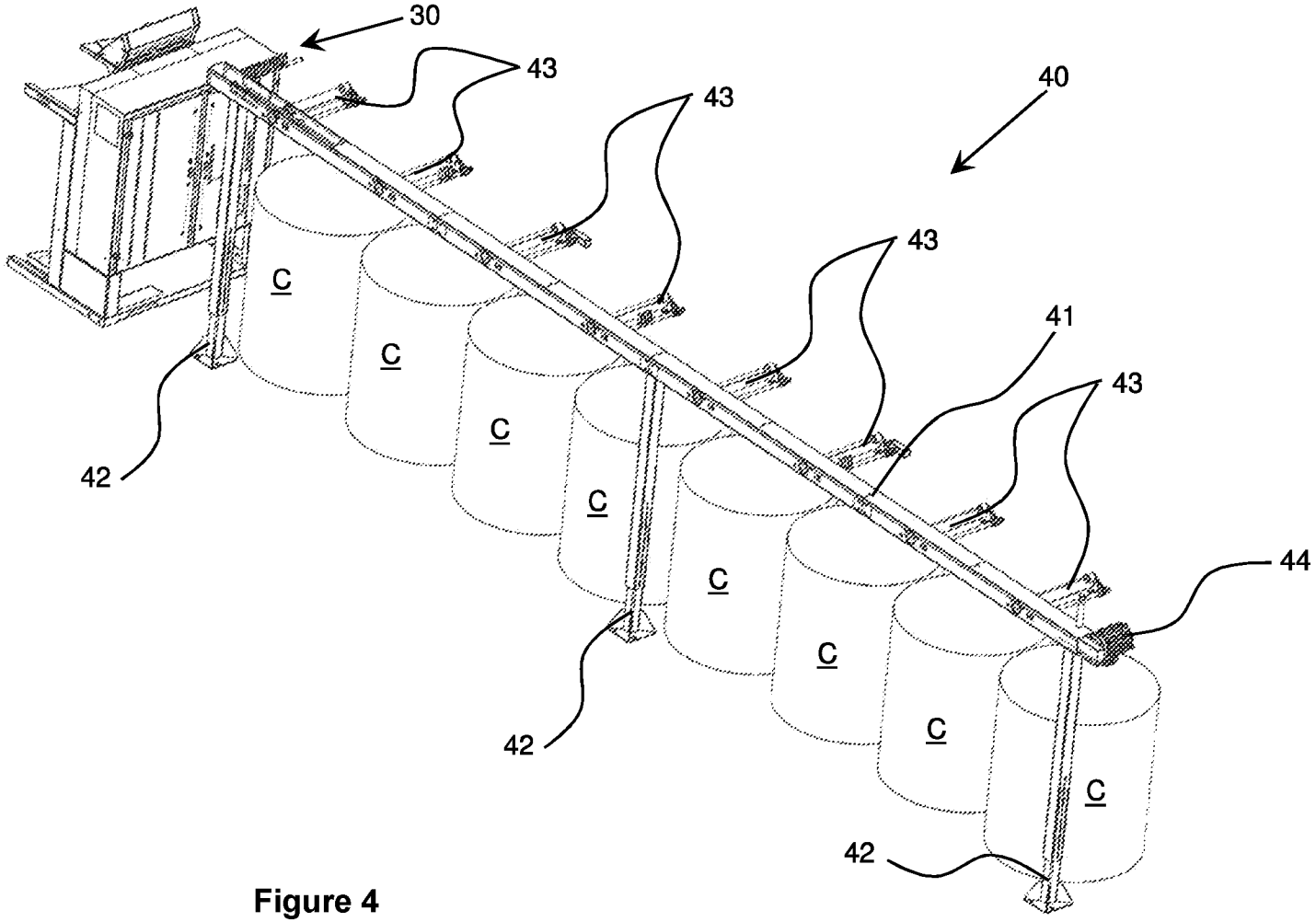
FIG. 4 shows a driven creel at the draw frame.
Figure 5:
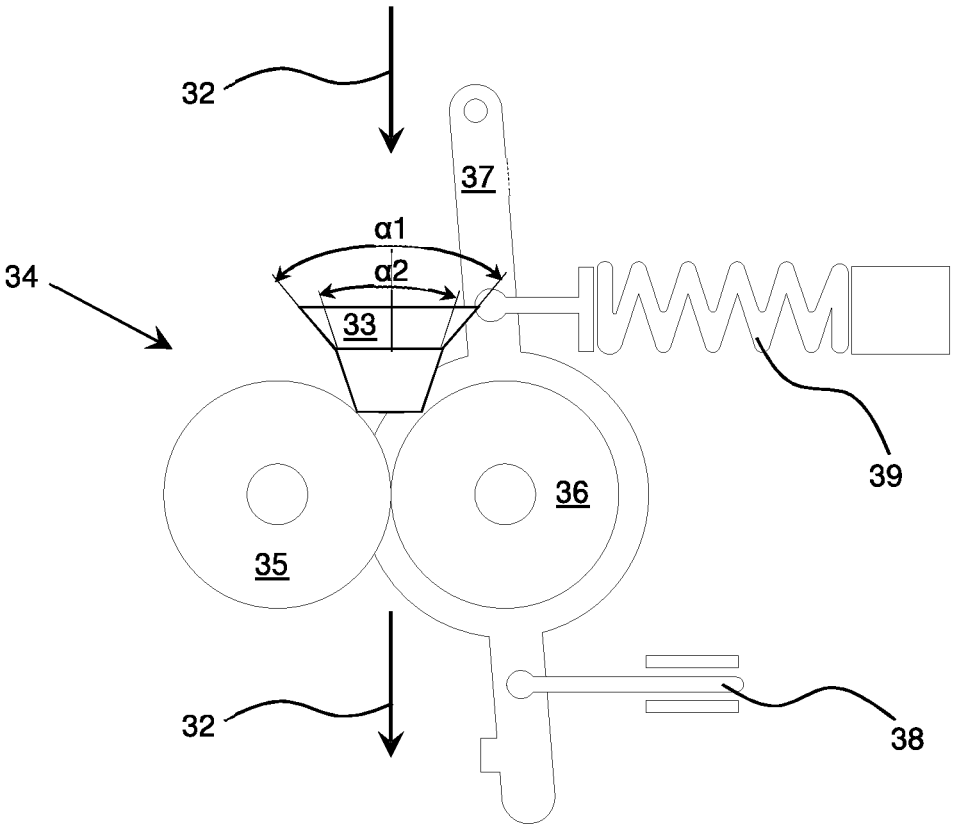
FIG. 5 shows a fibre sliver feed with measuring rolls at the draw frame.

The exemplary embodiment of FIG. 4 shows only one side of such a driven creel 40 in which fibre slivers are fed into the draw frame 30 from eight cans C. Since, for reasons of clarity, only one side of the creel 40 is shown, in reality by way of example 16 fibre slivers (not shown herein) are fed into the draw frame 30, where they are doubled and drafted. The creel 40 has a profile 41 which extends in the working direction of the draw frame 30 and is arranged above the cans C. For that purpose the profile 41 is mounted on at least one support 42 which is preferably height-adjustable. Rotatable guide elements 43 are arranged laterally on the profile 41, a rotatable guide element 43 being assigned to each can C. The guide elements 43 extend horizontally and at right-angles to the longitudinal axis of the profile 41 and guide the fibre sliver out of the cans C and into the drawing unit 30. They are driven by a drive element (not shown), which is arranged inside the profile 41. A drive 44, for example a controllable electric motor or a servomotor, is arranged on the profile 41 at an end opposite the draw frame 30. A belt drive or some other drive element that can be integrated into the profile 41 is used to drive the guide elements 43. This is effected in order to reduce the tensile forces on the fibre slivers resulting from the extended feed path of the fibre slivers into the draw frame 30 and the associated friction. Because the drive 44 is connected to the controller of the draw frame 30 but is drivable and controllable independently of the draw frame drive, the tension draft of the fibre slivers towards the draw frame 30 can be adjusted in an optimum way. The long approach path of the fibre slivers from the last can C to the drawing unit means that in the case of a non-driven creel a high degree of friction is produced which can be different for each fibre sliver. By means of the driven guide elements 43, such friction can be minimised and at the same time the tension draft of the fibre slivers towards the drawing unit can be adjusted.

The draw frame 30 is an autoleveller draw frame having a preliminary drafting zone and a subsequent main drafting zone. According to FIG. 5, for draw frame autolevelling 34 upstream of the draw frame 30 there is arranged a pair of scanning rolls 35, 36 with which fluctuations in the thickness of the fibre sliver are measured and levelled out in the draw frame 30. Upstream of the pair of scanning rolls 35, 36 there is also arranged a sliver guide in the form of a funnel 33 which is arranged to receive at least 9 fibre slivers and guide them into the pair of scanning rolls 35, 36. A first scanning roll 35 is arranged in fixed position at or on the draw frame 30. A second scanning roll 36 is arranged so as to be movable with respect to the first scanning roll 35, the second scanning roll 36 being movably mounted with a pivot point on a lever 37. The fibre sliver is guided and the mass fluctuations measured between the scanning rolls 35, 36. For that purpose the lever 37 is acted upon by a presser element 39 which can be in the form of a spring or piston. A constant force is thus exerted on the fibre sliver via the scanning roll 36. In the event of mass fluctuations, the scanning roll 36 moves resiliently back by way of the lever 37, with the result that a signal is produced in the sensor 38 which is processed in the controller of the draw frame 30 and adapts the draft of the draw frame 30 in the main draft. Upstream of the draw frame autoleveller 34 there is arranged a funnel 33 which has a variable inlet angle $\alpha$ in the sliver running direction 32. In this exemplary embodiment the funnel 33 is of two-step construction, the first step having an opening angle $\alpha 1$ of between 110° and 80°. The opening angle $\alpha 2$ of the second step is between 80° and 45°. Alternatively, the opening angle of the funnel can also be rounded and accordingly taper continuously from 110°-80° to 80°-45° without a step or shoulder. The funnel 33 having an opening angle that decreases in the sliver running direction 32 guides particularly the fibre sliver located on the outside of the creel 40 and effects pre-compacting of the fibre slivers.

The drawing of the incoming fibre slivers is effected with a factor of ≥8.5, preferably by the factor ≥9, at a draw frame speed of ≥500 m/min, resulting in a sliver of from 4.25 to 4.5 ktex which is deposited in a can C1 and fed to the airjet-spinning machine 50.

Each spinning station in the airjet-spinning machine 50 is fed from a can C1 with fibre sliver from the draw frame 30, which processes the fibre sliver at a speed of 500 m/min with a draft factor of 216. At this speed it is possible to produce a yarn of Ne30. With a yarn of Ne40 the production speed of the airjet-spinning machine is about from 420 to 470 m/min.

Because the carding machine has an integrated draw frame 20, the draw frame 30 operates with relatively high drafts and the draw frame 30 draws more than eight fibre slivers at the same time, the entire process can be optimised and two separate drawing units can be dispensed with.

Example

In a carding machine 10, fibre sliver made of viscose having a fineness of 9.45 ktex is processed at a production rate of 80 kg/h. A card sliver is formed which comes out of the integrated draw frame 20 with a quality of 3.05 ktex. The card sliver is drafted by the factor 3.1 at a speed of 437 m/min and deposited in a can C.

In total, 12 cans C with this fibre sliver are fed to the draw frame 30. That is to say, 12 fibre slivers are doubled with one another and drawn at a speed of 500 m/min. The drawing is effected with the factor 8.61, so that a fibre sliver having a quality of 4.25 ktex is formed at a production rate of 127.5 kg/h. Downstream of draw frame 30, the resulting fibre sliver is deposited in a can C1 and supplied to an airjet-spinning machine. The airjet-spinning machine processes the fibre sliver at a speed of 500 m/min and drafts or opens the fibre sliver by the factor 216, with the result that a viscose yarn of Ne30 is formed. Since each spinning station is fed by only one can C1, the production rate of that spinning station is 0.6 kg/h at 100% efficiency.

The invention is not limited in its implementation to the preferred exemplary embodiment defined above. Rather, it is possible to imagine a number of variants which also make use of the described solution, while implemented in fundamentally different ways. All the features and/or advantages resulting from the claims, the description or the drawings, including structural details or spatial arrangements, can be fundamental to the invention both individually and in an extremely wide variety of combinations.

The invention claimed is:

1. A process for processing fibres, comprising steps of:

producing on a carding machine a carded fibre sliver;

subjecting the carded fibre sliver to preliminary drawing in an integrated draw frame at the carding machine to produce a pre-drawn fibre sliver;

depositing the pre-drawn fibre sliver in respective ones of a plurality of first cans;

feeding draftfree at least 9 to 12 of the pre-drawn fibre slivers from a corresponding number of the first cans to a second draw frame and drawing the at least 9 to 12 pre-drawn fibre slivers on the second draw frame to form a drawn fibre sliver, wherein the number of first cans from which the at least 9 to 12 fibre slivers are fed draftfree to the second draw frame corresponds to the number of pre-drawn fibres being fed to the second draw frame;

depositing the drawn fibre sliver in respective ones of a plurality of second cans; and feeding the drawn fibre sliver from the respective ones of the second cans to a spinning station of an airjet-spinning machine.

2. The process according to claim 1, further including subjecting the drawn fibre sliver to at least 20-fold drawing with respect to the carded fibre sliver.

3. The process according to claim 1, wherein the subjecting step includes subjecting the carded fibre sliver to at least 2.5-fold, 3-fold or 3.5-fold preliminary drawing at the carding machine.

4. The process according to claim 1, wherein the carded fibre sliver has at least 2.9 ktex or 3.5 ktex.

5. The process according to claim 1, wherein the subjecting step includes subjecting the pre-drawn fibre sliver to at least 8-fold, 8.5-fold or 9-fold drawing in the second draw frame.

6. An installation for producing a yarn, wherein the installation includes: a carding machine; an integrated draw frame and a can changer arranged at the carding machine for receiving fibre sliver from the carding machine, preliminary drawing the fibre sliver without levelling by the intergrated draw frame to form pre-drawn fibre slivers and depositing the pre-drawn sliver in respective ones of a plurality of cans provided by the can changer; a single drawing unit in a form of an autoleveller drawing frame, wherein at least 9 to 12 pre-drawn fibre slivers are fed draftfree from a corresponding number of the cans to the single drawing unit; and a driven creel and an airjet spinning machine arranged downstream of the single drawing frame, and wherein the installation is adapted to be operated in accordance the process according to claim 1.

7. An installation for producing a yarn in accordance with an airjet-spinning method, comprising:

a carding machine for producing fibre sliver;

an integrated draw frame and a can changer arranged at the carding machine for preliminary drawing of the fibre sliver without levelling and depositing the preliminary drawn fibre sliver in respective ones of a plurality of cans arranged by the can changer;

a single drawing unit in a form of an autoleveller drawing unit arranged to receive the preliminary drawn fibre sliver from a respective one of the plurality of cans; and a driven creel and an airjet spinning machine arranged downstream of the single drawing unit.

8. The installation according to claim 7, wherein the carding machine has a transverse sliver take-off.

9. The installation according to claim 7 further including a sliver loop buffer arranged between the carding machine and the integrated draw frame.

10. The installation according to claim 7, wherein the driven creel includes a drive which is operable and controllable independently of a drive of the drawing unit.

11. The installation according to claim 7, wherein the single drawing unit includes a draw frame autoleveller which adapts a main draft of the single drawing unit to mass fluctuations of incoming fibre slivers.

12. The installation according to claim 11, further including a funnel arranged upstream of the draw frame autoleveller that has an opening angle that decreases in a sliver running direction.

13. The installation according to claim 12, wherein the opening angle decreases stepwise or continuously.

14. A process for processing fibres, comprising steps of:

producing on a carding machine a carded fibre sliver, subjecting the carded fibre sliver to preliminary drawing to produce a pre-drawn fibre sliver, wherein the subjecting step includes effecting the preliminary drawing of the fibre sliver at the carding machine without levelling;

depositing the pre-drawn fibre sliver in respective ones of a plurality of second cans;

feeding draftfree at least 9 to 12 of the pre-drawn fibre slivers from a corresponding number of the first cans to a second draw frame and drawing the at least 9 to 12 pre-drawn fibre slivers on the draw frame to form a drawn fibre sliver;

depositing the drawn fibre sliver in respective ones of a plurality of second cans; and feeding the drawn fibre sliver in respective ones of the second cans to a spinning station of an airjet-spinning machine.

15. A process for processing fibres, comprising steps of:

producing at least 80 kg/h of carded fibre sliver on a carding machine;

subjecting the carded fibre sliver to preliminary drawing to produce a pre-drawn fibre sliver;

depositing the drawn fibre sliver in respective ones of a plurality of second cans;

feeding draftfree at least 9 to 12 of the pre-drawn fibre slivers from a corresponding number of the first cans to a second draw frame and drawing the at least 9 to 12 pre-drawn fibre slivers on the draw frame to form a drawn fibre sliver;

depositing the drawn fibre sliver in respective ones of a plurality of second cans; and feeding the drawn fibre sliver in respective ones of the second cans to a spinning station of an airjet-spinning machine.

16. A process for processing fibres, comprising steps of:

producing on a carding machine a carded fibre sliver at a rate of at least 100 m/min;

subjecting the carded fibre sliver to preliminary drawing to produce a pre-drawn fibre sliver;

depositing the drawn fibre sliver in respective ones of a plurality of first cans;

buffering the carded fibre sliver at the carding machine during a change of one of the first cans at the carding machine to another one of the first cans;

during the change of the first cans at the carding machine, continuing to produce the carded fibre sliver in the carding machine at the rate of at least 100 m/min;

feeding draftfree at least 9 to 12 of the pre-drawn fibre slivers from a corresponding number of the first cans to a second draw frame and drawing the at least 9 to 12 pre-drawn fibre slivers on the draw frame to form a drawn fibre sliver;

depositing the drawn fibre sliver in respective ones of a plurality of second cans; and feeding the drawn fibre sliver in respective ones of the second cans to a spinning station of an airjet-spinning machine.

* * * * *